US006617857B1

(12) United States Patent
Franz et al.

(10) Patent No.: US 6,617,857 B1
(45) Date of Patent: Sep. 9, 2003

(54) DIS IGNITION SIGNAL PROCESSING FOR AUTOMOTIVE ENGINE ANALYZER

(75) Inventors: Martin P. Franz, Portage, MI (US); Scott R. Sebastian, Three Rivers, MI (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/895,831

(22) Filed: Jun. 29, 2001

(51) Int. Cl.[7] ..... F02P 17/00
(52) U.S. Cl. ..... 324/379; 324/402
(58) Field of Search ..... 73/116; 324/379, 324/393, 402, 380, 384; 701/29

(56) References Cited

U.S. PATENT DOCUMENTS

| | | | | | |
|---|---|---|---|---|---|
| 4,399,407 | A | | 8/1983 | Kling et al. | 324/379 |
| 4,476,531 | A | | 10/1984 | Marino et al. | 364/431.01 |
| 4,847,563 | A | * | 7/1989 | Sniegowski et al. | 324/384 |
| 4,937,527 | A | * | 6/1990 | Sniegowski et al. | 324/402 |
| 5,175,501 | A | * | 12/1992 | Loewe et al. | 324/380 |
| 5,641,898 | A | * | 6/1997 | Chang | 73/118.1 |
| 5,784,284 | A | | 7/1998 | Taraki | 364/487 |
| 5,898,307 | A | | 4/1999 | Taraki et al. | 324/379 |
| 5,916,287 | A | | 6/1999 | Arjomand et al. | 701/29 |
| 6,009,360 | A | * | 12/1999 | Knapp | 701/29 |
| 6,411,096 | B1 | * | 6/2002 | Anthoni et al. | 324/379 |
| 6,507,923 | B1 | * | 1/2003 | Wall et al. | 714/712 |
| 2002/0004694 | A1 | * | 1/2002 | McLeod et al. | 701/29 |

* cited by examiner

*Primary Examiner*—Jay Patidar
*Assistant Examiner*—Walter Benson
(74) *Attorney, Agent, or Firm*—Kinney & Lange, P.A.

(57) ABSTRACT

An engine analyzer senses and displays secondary ignition signals from a DIS engine using a two sets of test leads. The engine analyzer receives the secondary signals from both sets of leads and produces positive and negative peak values for each set of leads during each cylinder firing. Based upon the positive and negative peak values for both sets of leads, during each of the cylinder firings, the engine analyzer selects which lead set and which polarity will be used to supply the secondary voltage signal for each cylinder to be digitized and displayed.

17 Claims, 4 Drawing Sheets

DIS IGNITION SIGNAL PROCESSING FOR AUTOMOTIVE ENGINE ANALYZER

CROSS-REFERENCE TO RELATED APPLICATION(S)

None.

BACKGROUND OF THE INVENTION

The present invention relates to automotive engine analyzers. In particular, the present invention is an engine analyzer which automatically selects DIS secondary ignition signals for digitization and display.

Engine analyzers are used by automotive technicians and mechanics to test the operation of an automobile engine and to assist the technician or mechanic in evaluating the operation of an engine and identifying sources of poor performance or engine malfunction. The engine analyzer includes test leads, probes, and other sensors which are connected to the engine to sense signals or operating parameters of the engine.

One important subsystem of an automobile engine which is tested is the ignition system. This system delivers electrical voltages to spark plugs to cause ignition of a compressed fuel and air mixture at or near the top of the compression stroke of the piston in each cylinder. The firing of the spark plug ignites the fuel and air mixture, causing an explosion which drives the piston downward to produce the power stroke. There are a number of different components within the ignition system which can result in the failure to produce a spark at a particular cylinder or the production of a spark which is less than optimal. For example, a spark plug may be defective, or may have an improper spark gap; a spark plug wire may be detective or failing; an ignition coil may fail; or components of the distributor or electronic ignition control circuitry may be failing or malfunctioning. Many of these problems can be detected by a skilled mechanic by viewing displays of secondary ignition voltage waveforms. These waveforms show secondary voltage applied to the individual spark plugs as it varies as a function of time. Different component failures cause characteristic changes to the shape and appearance of waveforms.

Originally, automotive engine analyzers used analog oscilloscope displays to display ignition waveforms for the mechanic. In 1982, Bear Automotive Service Equipment Company introduced the Bear ACE engine analyzer, which featured a single raster scan display for displaying all information, including simulated representations of engine ignition waveforms. The ACE analyzer digitized time varying signals, such as primary and secondary ignition signals, stored the digital samples, and subsequently displayed the waveform(s) on the raster scan display based upon those digitized samples. A digital engine analyzer in which waveforms are digitized and then displayed became the industry standard during the 1980's and has continued to be the industry standard today.

For many decades, most automobile engines used a distributor to produce the secondary voltage pulses and to distribute those pulses to the individual spark plugs. In the 1970's, solid state ignition systems began to be used in place of the mechanical breaker points traditionally used in distributor type ignition systems. The distributor type ignition system uses a single ignition coil to produce the voltage pulses and a rotor which distributes the secondary voltage pulses in sequence to the spark plug wires connected to the spark plugs. In the 1980's, distributorless ignition systems (DIS) were introduced to replace the traditional distributor type ignition systems. DIS ignition systems typically use one ignition coil for each pair of spark plugs. The spark plug pairs are selected so that one spark plug will fire when its cylinder is at the top of the compression stroke, while the other spark plug fires while its cylinder is at the top of the exhaust stroke. An electronic control circuit controls the flow of primary current through the primary winding of the DIS ignition coil and interrupts the flow of primary current at the appropriate time to induce a secondary voltage pulse in the secondary winding of the DIS ignition coil. A spark plug is connected to each end of the secondary winding of the DIS ignition coil. One of the two spark plugs, therefore, will fire from a positive going voltage pulse with respect to ground, while the other spark plug of the pair fires with a negative going pulse with respect to ground.

The introduction of DIS ignition systems presented a new set of challenges to designers of automotive engine analyzers. The engine analyzer needed to be adaptable to handle both distributor type ignition systems as well as DIS systems. The distributor type ignition system required only a single secondary voltage probe, which would clip onto the high voltage lead from the secondary winding of the single ignition coil to the center terminal of the distributor. Secondary voltage pulses would be produced in succession in the high voltage lead from the coil to the distributor, and those pulses would be distributed to the individual spark plug wires by the rotor of the distributor. A #1 probe from the engine analyzer would be connected to the #1 spark plug wire, in order synchronize the operation of the engine analyzer with the engine. By sensing the #1 pulse as well as each secondary voltage pulse (or each primary voltage pulse), the engine analyzer could produce a cylinder count which would accurately reflect which cylinder in the firing order of the engine was currently firing.

With a DIS engine having pairs of spark plugs sharing ignition coils, there is no longer a single lead from the ignition coil to a distributor. In order to sense secondary voltage in a DIS engine, therefore, individual probes need to be connected to the individual spark plug wires. The engine analyzer must selectively invert the signals from half of the cylinders, so that all of the ignition voltage pulses appear on the display screen with the same polarity. Typically, ignition waveforms are displayed so that the secondary voltage pulse is a positive going pulse. This requires that any negative going pulses which are to be displayed must be inverted. Finally, in order to synchronize the engine analyzer with the engine to identify the proper cylinder as they fire, the #1 cylinder power firing event must be identified. During each complete engine cycle, the #1 spark plug wire will receive two pulses: one during a power firing event, and one during an exhaust or wasted firing event. The #1 cylinder power firing event needs to be identified.

In the past, engine analyzers have typically used two sets of leads for connection to the spark plug wires of a DIS engine. These leads are typically color coded and may be, for example, a set of black leads and a set of red leads. The instructions to the mechanic require that all of one set of leads are connected to spark plug wires of one polarity, and the other set of leads are connected to spark plug wires for the opposite polarity. For example, if all black leads are connected to positive firing spark plug wires, then all red leads are connected to negative firing spark plug wires.

The requirement that particular leads be connected to particular polarities complicates the set up of the engine analyzer when analyzing a DIS engine. Even when the mechanic makes the proper connections, problems can still be encountered. For example, replacement ignition coils for DIS engines may be wound in an opposite direction from the original parts. When replacing a detective coil with a replacement coil, a reversal of the polarities of the respective cylinders may occur. Although the engine will operate properly regardless of the polarity of by the ignition coil, the engine analyzer will not. If polarities are reversed on certain leads, the signals derived will have incorrect polarities when processed and displayed by the engine analyzer. This can also result in misidentification of the proper #1 cylinder firing event.

More recently, ignition systems have been developed in which a single coil is used for each cylinder (a so called "coil per cylinder") ignition system. In addition to the distributor type ignition systems, the engine analyzer must also be capable of working with engines having either a pair of cylinders per coil or a single cylinder per coil. It is desirable to use the same set of leads for both ignition systems with a coil or coil pack for a pair of cylinders, as well as ignition systems with a coil per cylinder.

BRIEF SUMMARY OF THE INVENTION

The present invention processes and selects secondary ignition signals while simplifying the connection of leads required to be made by the mechanic. Two sets of secondary ignition signal leads are provided, and one lead is connected to sense the secondary voltage pulse supplied to each spark plug. With an engine having a coil for each pair of cylinders, a lead from one set is connected to one of the two spark plug wires and the other lead is connected to the opposite spark plug wire (i.e., on opposite sides of the ignition coil). There is no requirement, however, that all spark plugs of one polarity be connected to one set of leads and all of the opposite polarity be connected to the other set.

The engine analyzer receives the secondary signals produced by both sets of leads. For each cylinder firing, the signal strength on each lead set in both positive and negative directions is determined. Based upon the relative signal strengths from the leads in positive and negative directions during each cylinder firing event, the engine analyzer determines which lead and polarity should be selected when that cylinder fires in the future. The engine analyzer routes the secondary voltage signal, from the appropriate lead set with the appropriate polarity to an analog-to-digital converter, which digitizes the secondary voltage waveform for subsequent analysis or display.

DETAILED DESCRIPTION

Figure 1:
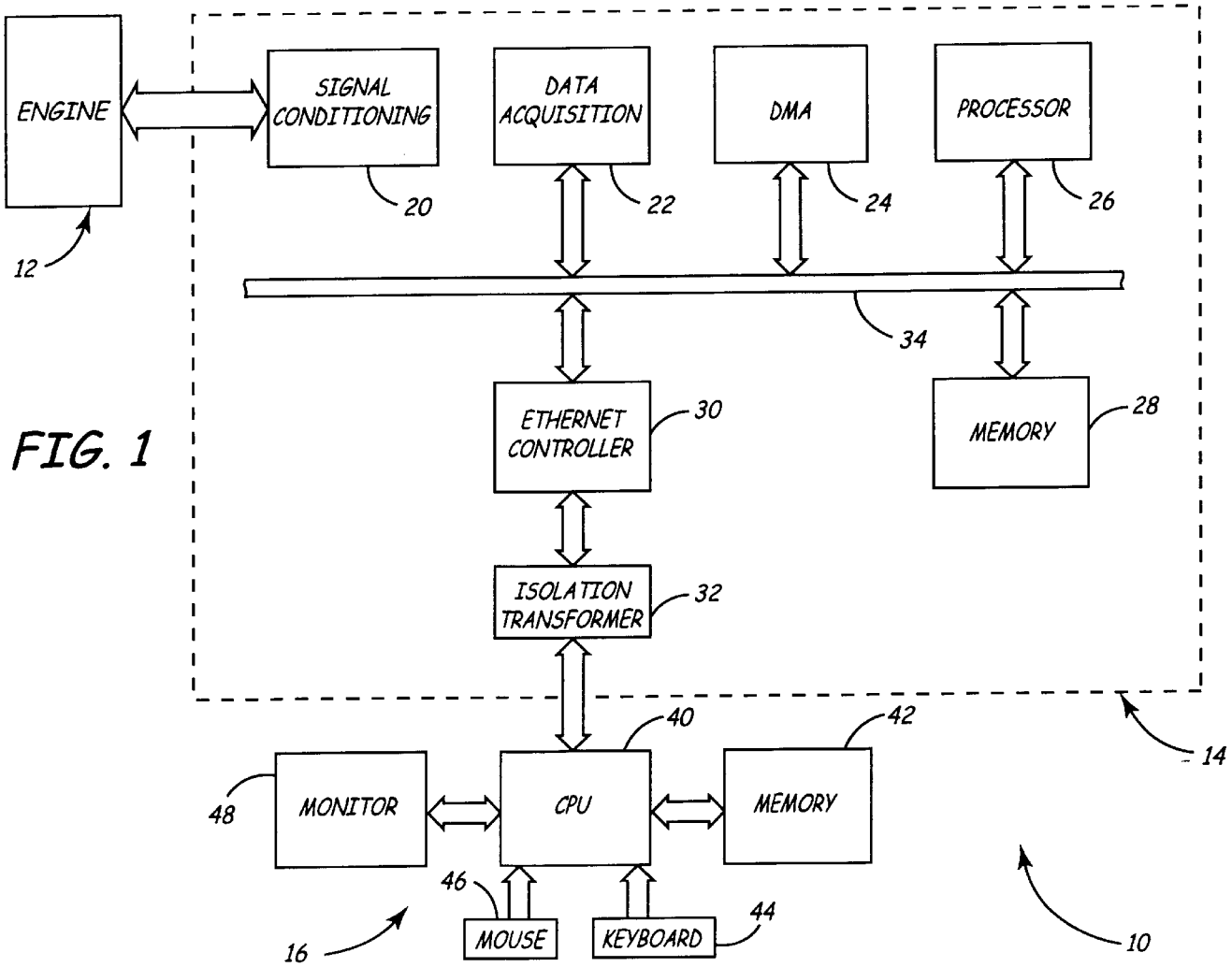
FIG. 1 is a block diagram of an engine analyzer system.

FIG. 1 is a block diagram of engine analyzer system 10, which is used by a mechanic to make measurements, perform tests, and diagnose failures and malfunctions of automotive engine 12. System 10 includes engine analyzer module 14 and host computer 16. Engine analyzer module 14 is connected to components and systems of engine 12 to derive electrical signals which are conditioned, acquired, stored, and then transferred to host computer 16 for further analysis and display. Typical signals derived from engine 12 by engine analyzer module 14 include #1 cylinder, primary ignition, secondary ignition, amps signals, volt-ohmmeter (VOM), voltage probe, vacuum, and battery signals. The signals may be used to make individual measurements, to derive timing signals and engine RPM, and dwell times, and to provide time varying waveforms for display so that they can be analyzed by the mechanic.

Engine analyzer module 14 includes signal conditioning circuitry 20, data acquisition circuitry 22, direct memory access (DMA) controller 24, processor 26, memory 28, Ethernet controller 30, isolation transformer 32, and main bus 34. The signals derived from engine 12 are first conditioned by signal conditioning circuitry 20 so that the signal levels are within appropriate ranges for conversion from analog to digital form. Data acquisition circuitry 22 selects the signal of interest to be converted and performs analog-to-digital (A/D) conversion of the selected signal. Those signals which are digitized for later display as a time varying waveform are subject to high speed analog to digital conversion. Those signals which are converted to a single value are subjected to high resolution A/D conversion. In the present invention, when engine 12 has a DIS type ignition system, data acquisition circuitry 22 samples the secondary voltage signals derived from engine 12 and makes a determination of which lead and what polarity is producing the secondary voltage signal of interest at any given time. That information is used by data acquisition circuitry 22 to select the proper signal for high speed analog-to-digital conversion, so that the appropriate secondary voltage waveform for each cylinder is displayed. Data acquisition circuitry 22 also determines, in the case of an engine with DIS ignition system, which signal represents a compression or power firing event of the #1 cylinder. That information is used to synchronize data acquisition circuit 22, and engine analyzer module 14, to the operation of the engine 12.

DMA controller 24 transfers digital values produced by data acquisition circuit 22 to memory 28. Thereafter, Ethernet controller 30 can transfer stored values to host computer 16 for storage and display. Processor 26 coordinates the overall operation of engine analyzer module 14, so that the proper information is gathered and then transferred to host computer 16.

As shown in FIG. 1, host computer 16 includes central processing unit (CPU) 40, memory 42, keyboard 44, mouse 46, and monitor 48. The mechanic communicates with engine analyzer 10 through keyboard 44 and mouse 46, based upon instructions and prompts which are provided through monitor 48. For example, information regarding the particular model of car, the number of cylinders in the engine, the type of ignition system, and the firing order may be provided. In addition, the mechanic provides inputs through keyboard 44 and mouse 46 to select particular test or particular information which is to be collected and displayed on monitor 48.

When the mechanic is interested in seeing a display of a particular waveform on monitor 48, a selection is made through keyboard 44 or mouse 46. CPU 40 provides instructions to engine analyzer module 14, which are provided to processor 26. Based upon the instructions received from CPU 40, processor 26 provides the necessary control instructions to data acquisition circuit 22 and DMA 24 to cause the signal of interest to be selected, sampled, and stored in memory 28. In a preferred embodiment, engine analyzer module 14 digitizes and stores waveform data for an entire engine cycle in memory 28. The waveform data can then be transferred to host computer 16. This allows the host computer to select whatever cylinder is of interest, and to display one or more waveforms on monitor 48, as requested by the mechanic. The conversion and storage process is fast enough that waveform data is updated so that the display appears to be a live presentation of the waveform of interest.

Figure 2:
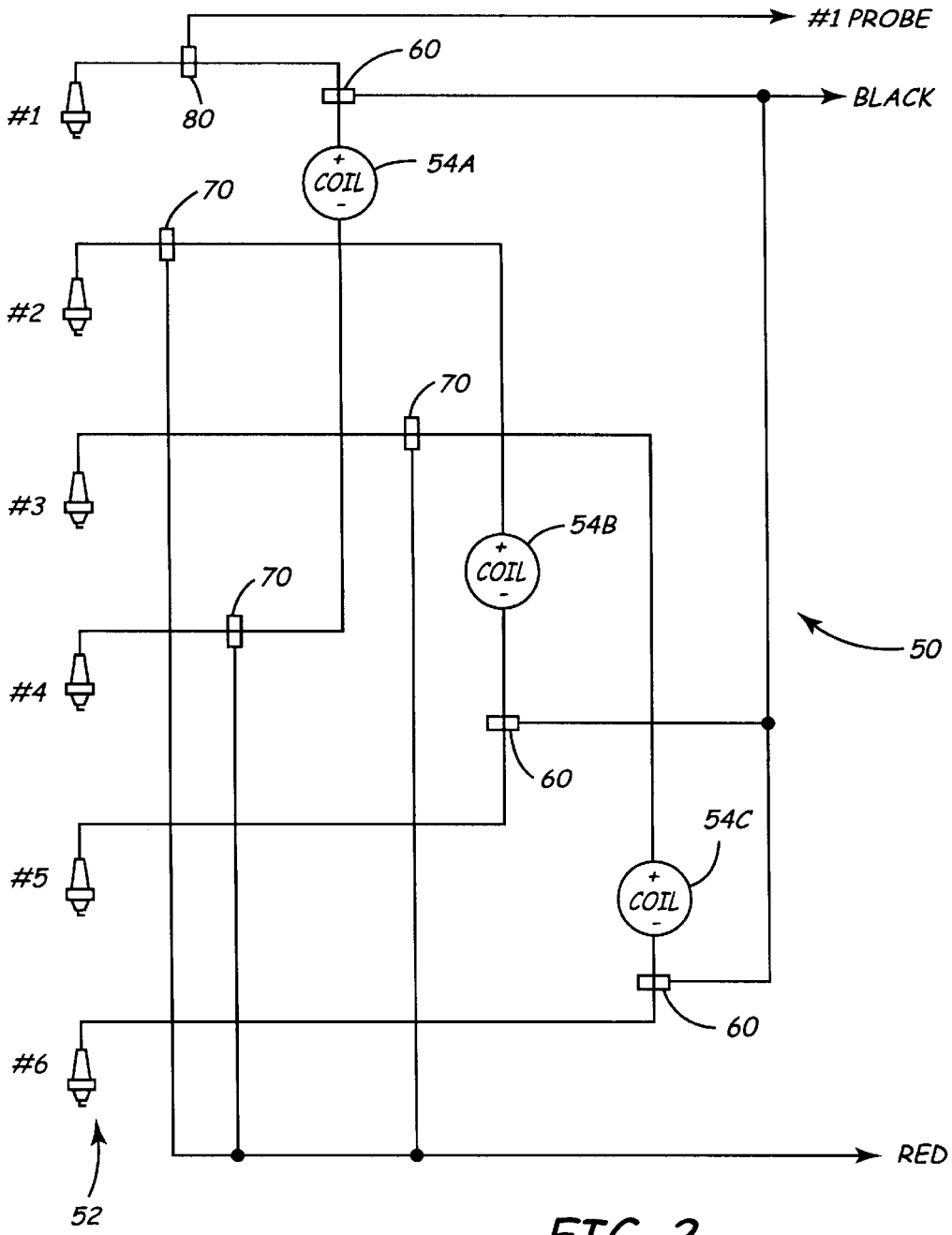
FIG. 2 shows the connection of leads to a DIS ignition system.

The present invention is concerned with improved handling of DIS secondary ignition signals derived from engines having DIS ignition systems. FIG. 2 is a diagram showing a portion of DIS ignition system 50, and one possible hook-up of test leads to that ignition system. In the example shown in FIG. 2, DIS ignition system 50 for a 6 cylinder engine having six spark plugs 52 and three ignition coils 54. Spark plugs 52 are labeled with their respective cylinder numbers (#1–#6).

In ignition system 50, a pair of spark plugs share a common ignition coil. For example, spark plugs for cylinders #1 and #4 are connected to opposite terminals of ignition coil 54*a*. Spark plugs for cylinders #2 and #5 are connected to opposite terminals of ignition coil 54*b*. The spark plugs for cylinders #3 and #6 are connected to opposite terminals of ignition coils 54*c*.

The pairing of spark plugs to be connected to common ignition coil is based upon the position of the respective cylinders in the firing order of the engine. When a pair of spark plugs are fired by a secondary pulse from one of the ignition coils 54, one of the two cylinders will be at the top of the compression stroke, while the other is at the top of the exhaust stroke. The next time a firing occurs for that pair of spark plugs, the strokes will be reversed. During each engine cycle, both spark plugs of a pair will fire twice—once on compression, and once on exhaust.

Because the pairs of spark plugs are connected to opposite secondary winding terminals of the ignition coil, they will fire with opposite polarity voltages with respect to engine ground. For example, in FIG. 2, the spark plugs for cylinders #1, #2, and #3 are connected to positive terminals of ignition coils 54*a*, 54*b*, and 54*c*, respectively. Sparks plugs for cylinders #1, #2, and #3 will fire, therefore, with positive going secondary voltage pulses. On the other hand, the spark plugs for cylinders #4, #5, and #6 are connected to negative terminals of coils 54*a*, 54*b*, and 54*c*, respectively. Those spark plugs will fire with negative going voltage pulses.

The secondary voltage signals in DIS ignition system 50 are sensed by a set of black leads 60, and a set of red leads 70. Black leads 60 are connected together to provide a single BLACK secondary signal. Similarly, red leads 70 are connected together to provide a single RED secondary voltage signal.

The present invention simplifies the connection of black leads 60 and red leads 70 to DIS ignition system 50. Unlike prior systems, which require all red leads to be connected to one polarity and all black leads to be connected to the opposite polarity, in the present invention there is no requirement that all black leads have one polarity and all red leads have an opposite polarity. Instead, the only requirement is that for each coil 54*a*–54*c*, one of the black leads 60 is connected to one side of the coil, and one of the red leads 70 is connected the opposite side of the coil. In the particular example shown in FIG. 2, black leads 60 are connected to the positive side of coil 54*a* and the negative side of coils 54*b* and 54*c*. Conversely, red leads 70 are connected to the negative side of coil 54*a* and the positive sides of coils 54*b* and 54*c*. Other connections are possible, as long as black and red leads 60, 70 are connected on opposite sides of each coil. In FIG. 2, #1 probe 80 is also connected to the spark plug wire leading from coil 54*a* to the #1 cylinder spark plug. The #1 probe signal is used in conjunction with the RED and BLACK signals, to provide synchronization of engine analyzer module 14 with ignition system 50 and engine 12. By using the #1 probe signal produced by probe 80 in conjunction with information gathered from the RED and BLACK signals, data acquisition circuit 22 produces a synchronized cylinder count which is synchronized to the actual engine firing order of engine 12. In one embodiment of the present invention, the identification of the #1 cylinder compression or power firing event is aided by connecting a lead of specified color (such black lead 60) to the #1 spark plug wire.

Figure 3:
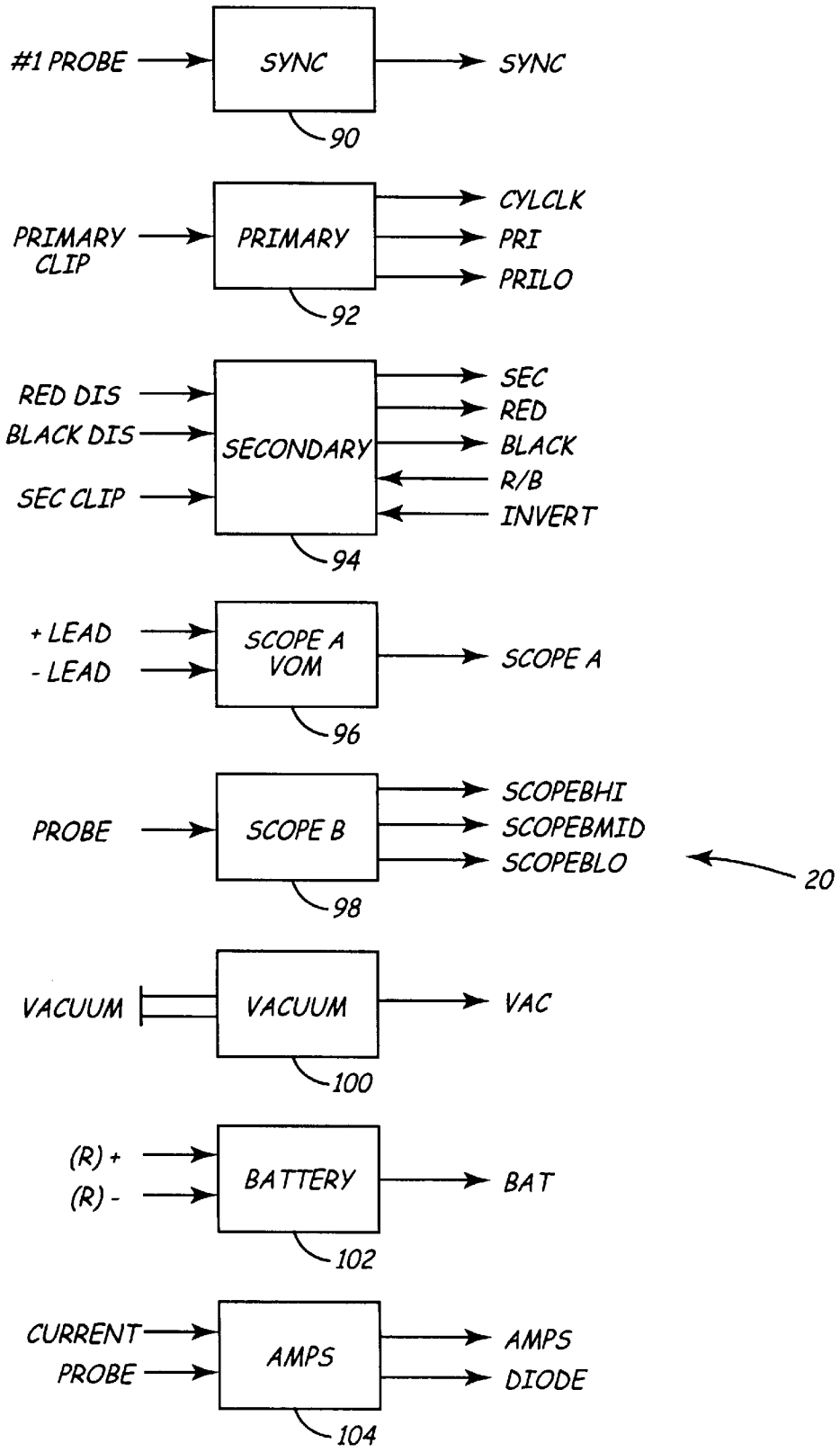
FIG. 3 is a block diagram of the signal conditioning circuitry of the engine analyzer system of FIG. 1.

FIG. 3 is a block diagram showing signal conditioning circuits 20 in more detail. Signal conditioning circuitry 20 includes Sync circuit 90, Primary circuit 92, Secondary circuit 94, Scope A/VOM circuit 96, Scope B circuit 98, Vacuum circuit 100, Battery circuit 102, and Amps circuit 104. Each of the individual circuits 90–104 includes analog circuitry used to condition the particular input signal which it receives and to provide output signals to data acquisition circuit 22 for digitization.

Sync circuit 90 receives the #1 signal from the #1 probe 80 shown in FIG. 2. The output of sync circuit 90 is the SYNC signal is a logic pulse each time a firing of the #1 spark plug is sensed by #1 probe 80.

Primary circuit 92 receives inputs from a primary voltage clip lead. The outputs of primary circuit 92 include a cylinder clock signal CYLCLK, a normal primary voltage signal PRI, and a low voltage primary signal PRILO.

Secondary circuit 94 receives the BLACK and RED signals from the set of black leads 60 and the set of red leads 70 shown in FIG. 2. These signals are active when leads sets 60 and 70 are connected to a DIS ignition. When the engine has a distributor type ignition system, a conventional secondary voltage probe (such as a "T-Clip") is clipped onto the high tension wire which connects the secondary of the ignition coil to the center post of the distributor. Secondary circuit 94 receives the SEC CLIP input as well. For any given engine, either the RED and BLACK signals will be present, or the SEC CLIP signal will be present.

The output of secondary circuit 94 include a secondary voltage SEC signal an red voltage RED signal representing the voltage from the set of red leads 70, and a black voltage BLACK signal representing the voltage received from the set of black leads 60. As shown in FIG. 3, secondary circuit 94 also receives as input two control signals from data acquisition circuit 22. Those input signals are a red/black select (R/B) signal and polarity selection (INVERT) signal. The R/B and INVERT signals select which lead set (red or black) will be used to be produce the secondary voltage signal SEC, and whether the signal from the selected lead set will be inverted in order to produce the SEC signal. In other words, data acquisition circuit 22 determines the origin and polarity of the SEC signal. As will be discussed in further detail later, that determination is based upon the RED and BLACK signals supplied by secondary circuit 94.

Scope A VOM circuit 96 produces a Scope A high voltage output based upon the voltage appearing between positive (+) and negative (–) leads.

Scope B circuit 98 receives an input from a voltage sensing probe, and provides output signals in high, mid, and low voltage ranges.(SCOPEBHI, SCOPEBMID, SCOPEBLO).

Vacuum circuit 100 receives a vacuum pressure signal from a vacuum input. A vacuum pressure sensor within vacuum circuit 100 provides an electrical signal which is a function of sensed vacuum pressure. The output from vacuum circuit 100 is a VAC signal.

Battery circuit 102 receives inputs from positive and negative leads, and provides a battery voltage (BAT) output signal.

Amps circuit 104 receives a inputs from a current probe and provides two output signals AMPS and DIODE.

Figure 4:
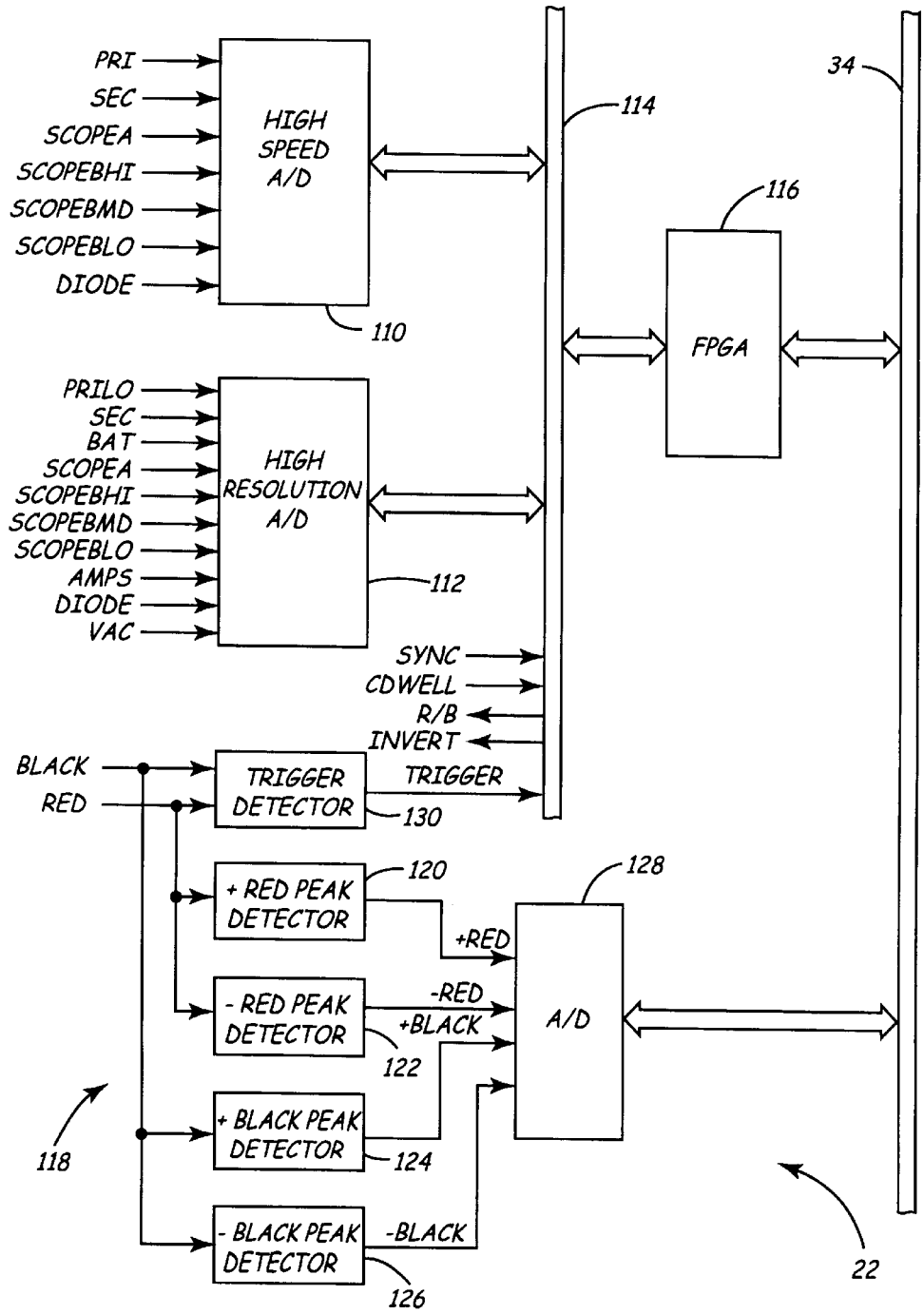
FIG. 4 is a block diagram of the data acquisition circuitry of the engine analyzer system of FIG. 1.

FIG. 4 shows data acquisition circuit 22, which includes high speed analog to digital (A/D) converter circuitry 110, high resolution A/D 112, internal bus 114, field programmable gate array (FPGA) 116, and DIS signal sampling circuitry 118 (which includes peak detectors 120, 122, 124, and 126), A/D converter 128, and trigger detector 130.

FPGA116 is a programmable logic circuit which controls the data acquisition process by controlling the operation of high speed analog to digital (A/D) converter 110 and high resolution analog-to-digital (A/D) converter 112. This control includes a control of the sample times and rates, and control of the particular input signal to be digitized by A/D converters 110 and 112. In addition, FPGA116 controls which of the DIS secondary ignition voltage inputs will be used to produce the secondary voltage, by supplying the RED/BLACK and INVERT signals to secondary signal processing circuit 94 (FIG. 3).

In one embodiment, FPGA116 is a EMF6016TC144 programmable logic circuit. FPGA116 receives instructions from processor 26 indicating what data is to be acquired. Depending upon the data of interest, either the high speed A/D converter 110 or high resolution A/D converter 112 will be used to collect the data.

Trigger detector 130 receives the RED and BLACK ignition signals and compares those signals to positive and negative threshold values to detect the beginning of cylinder firing event. The output of trigger detector 130 is a TRIGGER signal, which is a cylinder event interrupt to FPGA116.

The present invention is related to the handling of DIS secondary ignition signals. The following discussion FPGA116 will focus on digitizing DIS secondary voltage waveforms.

In order to digitize waveforms, high speed A/D converter 110 is used. FPGA116 selects high speed A/D converter 110, and provides a select signal to select the SEC signal input for digitization. FPGA116 also provides the clock signals used by high speed A/D converter 110. The sample rate of high speed A/D converter 110 is controlled so that a fixed number of samples (for example 1,024 samples) is provided for each cylinder. The data samples produced by high speed A/D converter 110 are transferred by DMA controller 24 to memory 28 (See FIG. 1). FPGA116 measures engine period using the CYLCLK signal (which is received from primary circuit 92 and logically ORed and with the SEC signal) controls the sample rate of high speed A/D converter 110 as a function of engine period.

FPGA116 causes a whole engine cycle to be digitized, beginning with cylinder #1. Each cylinder's data is stored in a waveform buffer of memory 28. If a specific cylinder is to be displayed, CPU 40 retrieves the waveform data for that particular cylinder and displays the waveform on monitor 48.

FPGA116 maintains two cylinder counts: a "SYNC count" which is synchronized to the engine by the SYNC (#1) signal, and a"SWIM count" which is not synchronized to the firing order of the engine. Both counts make use of information received from host computer 16 as to the number of the cylinders in the engine under test.

The SWIM count is used in conjunction with signals from DIS circuitry 118 to select the particular lead and polarity to be used for each cylinder in producing the secondary (SEC) ignition signal sampled to high speed A/D converter 110. The SYNC and SWIM counts are incremented in response to the cylinder clock (CLYCLK) signal.

During each cylinder firing event, peak detectors 120, 122, 124, and 126 detect the positive and negative going peaks, and provide those peak values to A/D converter 128. The red lead will have both a +RED and a −RED peak value, and the black lead will have a +BLACK and a −BLACK value. Values provided to the input of AID converter 128 all have the same polarity. Each of the four values (+RED, −RED, +BLACK, −BLACK) are converted to digital values by A/D converter 128 in response to control signals from FPGA116, and all four digital values are supplied for each cylinder.

Processor 26 and memory 28 maintain a "spark table" which is a moving average of the +RED, −RED, +BLACK, and −BLACK digital values for each cylinder. Every four engine cycles, processor logic 26 checks the spark table and determines which of the four averages is the largest for each cylinder. Based upon that determination, processor logic 26 loads into a pair of registers (RED/BLACK and INVERT/DON'T) in FPGA116 an identification of the lead (RED or BLACK) and the polarity (+or−)for that particular cylinder. The cylinder is identified by its particular "SWIM" count. During the next four engine cycles, the values in the RED/BLACK and INVERT/DON'T registers will be used to produce the RED/BLACK and INVERT signals. Thus, the secondary signal representing a power (or combustion) firing event, that is, the one with the largest average, is identified for each cylinder.

FPGA116 determines the time for switching the source of the SEC signal from one cylinder to the next (e.g., by using the TRIGGER or CYLCLK signal) to determine the time between engine firing events. FPGA116 selects a time period which is approximately ⅔ of the time from one cylinder firing event to the next, and sets a PTS timer in response to each incoming TRIGGER pulse. When the PTS timer times out FPGA116 selects the next values of the RED/BLACK and INVERT signals based upon these SWIM count and the corresponding values in the RED/BLACK and INVERT/DON'T registers. Depending upon the state of the RED/BLACK and INVERT signals, the secondary signal processing circuitry 94 will route either a RED or BLACK signal, which is either inverted, or not inverted to the SEC input of high speed A/D converter 110.

By changing the particular lead and polarity prior to each cylinder firing, FPGA116 ensures that the firing event is always produced with the appropriate lead and polarity. The switching to that lead and polarity occurs slightly before the actual firing event so that the entire secondary voltage pulse.

The selection of leads and polarity is performed without the need for identifying which cylinder is the #1 cylinder. The selection is based upon the SWIM count, rather than the SYNC count. For the purpose of determining which lead and which polarity is needed for each cylinder's power firing event, it is not necessary to connect any particular lead to any particular cylinder. It is only necessary that the red and black leads are connected to opposite sides of each coil.

As engine speed increases the above idle speed, the ability to distinguish between peak voltages on the DIS leads decreases. For that reason, it is desirable to discontinue the updating of the RED/BLACK and INVERT/DON'T registers when engine speed increases beyond a particular threshold speed value. Processor 26 uses engine speed information to determine whether or not to update the registers. The updating is done periodically, such as every fourth engine cycle as long as engine speed is below the threshold value. Other numbers of engine cycles can, however, be used. The updating preferably is done at a particular cylinder, at the specific number of engine revolutions. For example, cylinder #2 may be selected as the cylinder which triggers the resetting of the RED/BLACK and INVERT/DON'T registers every fourth engine revolution.

Processor 26 also preferably performs error checking which determines whether a condition exists which makes the identification of lead and polarity inaccurate. For example, half of the cylinders in the RED/BLACK register should be "1" meaning that they are red leads, while the other half are "0" meaning that they are black leads. Similarly, half of the INVERT/DON'T register cylinders should be "1" indicating "invert" and the half should be "0" indicating "don't invert". Processor 26 can identify which coil is bad (resulting in erroneous information in one or both of registers by taking the first half of bits from each register and exclusively ORing them with the bits from the second half of the register. The presence of a "0" will identify a bad coil. This can then be identified to the mechanic through an error message displayed on monitor 48, or used to correct the bits in the register(s).

Another error checking routing that can be performed by processor 26 compares the difference in peak values between the two highest values from each cylinder. The difference between the two highest values for a particular cylinder should be greater than a predetermined level. If not, processor 26 looks to the companion cylinder (the cylinder connected to the other side of the same ignition coil) and determines the lead and polarity for that companion cylinder. Based upon the value of the companion cylinder, processor 26 can check the accuracy of the cylinder in question and make corrections to the register(s) as necessary.

FPGA116 identifies the #1 cylinder firing event in a very simple way. The SYNC signal is produced with each firing of the #1 cylinder, so that two SYNC pulses are produced during each engine cycle. One of the SYNC pulses represents the #1 cylinder firing event, and the other sync pulse represents the wasted spark which occurs when cylinder #1 is at the top of the exhaust stroke. In order to produce the SYNC count which is synchronized to the actual firing order of the engine, FPGA116 must identify which of the two SYNC pulses represents the #1 cylinder firing event.

As discussed previously, the preferred hook-up of the DIS leads specifies that a black lead 60 be connected to the #1 spark plug wire. If this is done, FPGA116 can identify which of two sync pulses is the #1 cylinder firing event. When a SYNC pulse is received, FPGA116 checks to see whether the cylinder then producing a secondary signal is identified as having a black lead. This can be done by checking the RED/BLACK register for the then current cylinder. If the cylinder has a black lead, the SYNC pulse is the #1 firing event. If the cylinder identified as having a red lead, then the sync pulse should be skipped, and the next following SYNC pulse should represent the #1 firing event.

With the present invention, the efficient collection of DIS secondary ignition waveforms is achieved, without requiring a complicated specific hook-up of DIS red and black leads to particular spark plugs. In addition, a simplified identification of #1 cylinder firing event is achieved. Even if replacement coils having opposite winding direction are present in the engine, the reversal of polarities of one or more of coils is accommodated without requiring any change in the hook-ups through the engine.

Although the present invention has been described with reference to preferred embodiments, workers skilled in the art will recognize that changes may be made in form and detail without departing from the spirit and scope of the invention.

What is claimed is:

1. An engine analyzer for sensing and displaying secondary ignition signals from an engine having a DIS ignition system, the engine analyzer comprising:

a first set of leads for connection to the DIS ignition system;

second set of leads for connection to the DIS ignition system;

peak detection circuitry connected to the first and second sets of leads for producing, for each cylinder firing event, four separate peak values which represent (a) a positive-going peak value for the first set of leads, (b) a negative-going peak value for the first set of leads, (c) a positive-going peak value for the second set of leads, and (d) a negative-going peak value for the second set of leads;

means for selecting which lead set and which polarity is used to supply a secondary voltage signal for each cylinder based upon the peak values for that cylinder;

means for digitizing the secondary voltage signal; and means for displaying information based upon the digitized secondary voltage signal.

2. The engine analyzer of claim 1 wherein the means for selecting maintains a table of average peak values for each cylinder and selects the lead set and polarity for each cylinder based upon which lead set and polarity produced a largest average peak value for that cylinder.

3. The engine analyzer of claim 2 wherein the means for selecting updates the selections of lead set and polarity at selected intervals.

4. The engine analyzer of claim 3 wherein the selected intervals are N engine cycles, where N is an integer.

5. The engine analyzer of claim 3 wherein the means for selecting updates the selections only if engine speed is less than a threshold level.

6. The engine analyzer of claim 1 and further comprising:

a #1 probe for providing a #1 probe signal representing firing of a #1 cylinder spark plug.

7. The engine analyzer of claim 6 and further comprising:

means for producing a sync cylinder count based upon sensed firing events and the #1 probe signal.

8. The engine analyzer of claim 7 wherein the means for producing a sync cylinder count identifies which pulses of the #1 probe signal represent a compression firing event based upon the lead set and polarity selected when the #1 probe signal pulses occur.

9. A method of digitizing secondary voltage signals of an ignition system of an internal combustion engine, the method comprising:

connecting first and second sets of leads to the ignition system to sense secondary voltage signals of individual cylinders of the engine;

detecting a positive-going peak value for the first set of leads during each cylinder firing event;

detecting a negative-going peak value for the first set of leads during each cylinder firing event;

detecting a positive-going peak value for the second set of leads during each cylinder firing event;

detecting a negative-going peak value for the second set of leads during each cylinder firing event;

selecting which lead set and which polarity to use in conjunction with each cylinder firing event based upon all four of the peak values detected for that cylinder;

supplying a sensed secondary voltage signal for each cylinder based upon a cylinder count and the selected lead set and polarity; and digitizing the sensed secondary voltage signal supplied.

10. The method of claim 9 and further comprising:

storing the digitized sensed secondary voltage signal.

11. The method of claim 10 and further comprising:

displaying a secondary voltage waveform based of the stored digitized sensed secondary voltage signal.

12. The method of claim 9 and further comprising:

maintaining a table of average positive-going and negative-going peak values from each lead set for each cylinder.

13. The method of claim 12 wherein selecting which lead set and which polarity to use for each cylinder is based upon the average peak values in the table for that cylinder.

14. The method of claim 9 wherein selecting is performed at intervals of N engine cycles.

15. The method of claim 9 and further comprising:

sensing a #1 cylinder firing; and determining whether the #1 cylinder firing is a combustion firing event based upon the lead set selected when the #1 cylinder firing occurs.

16. The method of claim 9 and further comprising:

initiating a change in the selected lead set and polarity used for suppling the sensed secondary voltage at a selected time interval after each cylinder firing event.

17. The method of claim 16 and further comprising:

determining a time period between cylinder firing events; and determining the selected timing interval as a fraction of the time period between cylinder firing events.

* * * * *